US006621221B2

(12) United States Patent
Ijzerman et al.

(10) Patent No.: US 6,621,221 B2
(45) Date of Patent: Sep. 16, 2003

(54) CATHODE RAY TUBE AND PICTURE DISPLAY DEVICE

(75) Inventors: Willem Lubertus Ijzerman, Eindhoven (NL); Marcellinus Petrus Carolus Michael Krijn, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/225,798

(22) Filed: Aug. 22, 2002

(65) Prior Publication Data

US 2003/0048064 A1 Mar. 13, 2003

(30) Foreign Application Priority Data

Aug. 27, 2001 (EP) ..... 01203233

(51) Int. Cl.[7] ..... H01J 29/46; H01J 29/50
(52) U.S. Cl. ..... 315/15; 313/414; 315/382
(58) Field of Search ..... 315/15, 14, 370, 315/382; 313/453, 414, 427, 444, 449, 441; H01J 29/46, 29/50

(56) References Cited

U.S. PATENT DOCUMENTS 4,814,670 A 3/1989 Suzuki et al. ..... 315/15
6,013,976 A * 1/2000 Gorski et al. ..... 313/412
6,111,350 A * 8/2000 Uchida et al. ..... 313/414
6,304,026 B1 * 10/2001 Nakamura et al. ..... 313/414
6,331,752 B1 * 12/2001 Tojyou et al. ..... 313/441
6,353,282 B1 * 3/2002 Tojyou et al. ..... 313/441
2002/0024286 A1 * 2/2002 Shirai et al ..... 313/414

FOREIGN PATENT DOCUMENTS

EP 0899768 A2 3/1999 ..... H01J/29/50
JP 011916 A 1/2000 ..... H01J/29/48

* cited by examiner

*Primary Examiner*—Don Wong
*Assistant Examiner*—Trinh Vo Dinh

(57) ABSTRACT

A color cathode ray tube (CRT) has an electron-optical system (1) for generating three electron beams (EBR, EBG, EBB), deflection means (2) and a screen (3). In operation, the deflection means (2) deflect the electron beams (EBR, EBG, EBB), so as to change a landing position of the beams on the screen (3). However, by deflecting the beams, the beams are defocused and the spot on the screen (3) changes. In a color cathode ray tube with a relatively large screen, the electron beam defocusing can be observed to be different in strength for each beam (EBR, EBG, EBB). The invention provides a solution to this problem by providing a modified DAF section (40) in the electron-optical system (1). The DAF section (40) comprises at least two electron lenses (L1, L2) having different strengths for each electron beam (EBR, EBG, EBB).

15 Claims, 8 Drawing Sheets

CATHODE RAY TUBE AND PICTURE DISPLAY DEVICE

Background of the Invention

The invention relates to a cathode ray tube comprising a display screen for converting an electron-optical image into a light image, and an electron-optical system comprising electron sources, juxtaposed in a plane, for emitting electrons;

a beam-shaping section for forming a first outer electron beam, a middle electron beam and a second outer electron beam from the electrons emitted by the respective electron sources;

a main lens for focusing the electron beams on the display screen;

deflection means for deflecting the electron beams across the display screen, and a DAF section for dynamically adapting the focusing and astigmatism of the electron beams in dependence upon a landing spot of the electron beams on the display screen.

The invention also relates to a picture display device comprising such a cathode ray tube.

An embodiment of such a cathode ray tube is known from U.S. Pat. No. 4,814,670.

In a picture display device comprising the cathode ray tube, three electron beams are generated by the electron gun, which beams are imaged on the display screen. The display screen has lines or dots of phosphors which luminesce when they are impinged upon by one of the electron beams.

For displaying color images, use is made of an electron gun in which three electron beams are generated which are juxtaposed in what is called an "in-line" plane. The three electron beams are focused on the display screen by the main lens. The display screen is provided with red, green and blue phosphors. Furthermore, the cathode ray tube is provided with means which ensure that each electron beam lands on its own phosphor, which means comprise, for example, a shadow mask. Each electron beam thus corresponds to one of the colors red, green and blue.

In a frequently used configuration of the electron beams, the first outer electron beam particularly corresponds to the color red, the middle electron beam corresponds to the color green and the second outer electron beam corresponds to the color blue.

The cathode ray tube has deflection means for deflecting the electron beams. Generally, the cathode ray tube has a neck around which magnetic deflection means are arranged. For deflecting the electron beams, the deflection means receive, in operation, a deflection current which is synchronized with a picture signal received by the picture display device.

As the electron beams are deflected by the deflection means, the electrons cover a longer path between the electron source and the landing spot on the display screen. More particularly, the electrons cover a longer path between the main lens and the display screen, in dependence upon the extent of deflection. As a result, the electron beam is out of focus on at least a part of the display screen and is imaged as a relatively hazy picture.

Furthermore, when deflecting the electrons, the deflection means act as an electron-optical quadrupolar lens which will hereinafter also be referred to as deflection lens. Due to this quadrupolar lens, astigmatism occurs and the shape of the electron beam changes in dependence upon the deflection. The strength of the quadrupolar lens increases with an increasing extent of deflection of the electron beam.

The resolution of a cathode ray tube is dependent on the size and shape of the image of the electron beam, referred to as the spot. The change of the extent of focusing and of the astigmatism of the electron beam due to the deflection reduces the quality of a spot. Consequently, the resolution of the cathode ray tube decreases, particularly in the corners of the display screen.

To reduce this effect, the electron gun is provided with a DAF section as is known from the above-mentioned U.S. Pat. No. 4,814,670. Particularly, the DAF section comprises an intermediate electrode which is provided with horizontal, elongated apertures on the side facing the focusing electrode. The focusing electrode is provided with vertical elongated apertures. "Horizontal" is herein understood to mean the direction parallel to the "in-line" plane and perpendicular to the direction of propagation of the electrons. "Vertical" is herein understood to mean the direction perpendicular to the "in-line" plane.

In operation, a dynamic focusing voltage is applied to the intermediate electrode so that an electron-optical quadrupolar lens is formed between the focusing electrode and the intermediate electrode. The strength of the main lens can also be adapted by means of the dynamic focusing voltage.

Generally, the deflection means are self-convergent in the horizontal direction. This means that the electron beams in the horizontal direction are substantially in focus throughout the display screen, which is at the expense of an increased overfocusing in the vertical direction.

The known color electron gun has a substantially equal design for the three electron beams. Consequently, the DAF section for the three electron beams has the same effect, i.e. the electron-optical quadrupolar lens formed, in operation, between the focusing electrode and the intermediate electrode has an equal strength for all of the three electron beams.

However, since the three electron beams are juxtaposed in the in-line plane and are situated at a given mutual distance from each other, for example, at a distance of 6 mm at the location of the deflection means, they travel along different paths through the magnetic field of the deflection means deflecting the three electron beams. Consequently, the deflection lens has mutually different strengths for the three electron beams. This effect is referred to as "color-dependent defocusing".

It has been found that color-dependent defocusing affects the resolution of the cathode ray tube to a considerable extent, notably in a cathode ray tube for a computer monitor, a cathode ray tube having a relatively large deflection angle of the electron beams and a cathode ray tube without a shadow mask, referred to as Flat Intelligent Tracking (FIT) cathode ray tube.

Generally, the DAF section is adjusted in such a way that, in operation, the middle electron beam is substantially in focus throughout the display screen, while the outer electron beams are then no longer in focus at the edges and particularly in the corners of the display screen.

The color-dependent defocusing is then notably visible because the first outer electron beam is overfocused in the vertical direction on the east side of the display screen, which, viewed from the exterior, is the right-hand side. Generally, the first outer electron beam corresponds to the color red, and in this case the red spot is hazy. On a relatively large color monitor with a relatively high resolution, red characters may be out of focus on the east side of the screen.

Moreover, the second outer electron beam is overfocused in the vertical direction on the west side of the screen, which, viewed from the exterior, is the left-hand side. Generally, the second outer electron beam corresponds to the color blue and in this case the blue spot is hazy. On a relatively large color monitor with a relatively high resolution, blue characters may be out of focus on the west side of the screen.

The known cathode ray tube has the drawback that color-dependent defocusing occurs.

SUMMARY OF THE INVENTION

It is an object of the invention to provide a cathode ray tube having an improved focusing of the outer and inner electron beams at the edges, and particularly in the corners, of the display screen.

It is a further object of the invention to provide a picture display device comprising such a cathode ray tube.

In the cathode ray tube according to the invention, the first object is achieved in that the DAF section comprises a first electron lens, which has mutually different strengths for the electron beams, and a second electron lens, which has mutually different strengths for the electron beams, the strengths of the second electron lens being changeable independently of the strengths of the first electron lens.

In operation, the DAF section in the cathode ray tube according to the invention compensates the color-dependent defocusing because there is always a linear combination of the first and the second electron lens that acts on the electron beams.

A cathode ray tube in which the color-dependent defocusing is partly inhibited by placing an extra electrode between the focusing electrode and the DAF section is known from patent application EP-A-0 899 768. By means of this electrode, an electron-optical quadrupolar lens can be formed, in operation, for the outer electron beams. This lens acts on the outer electron beams with the same strength but with opposite sign.

However, it has been found that color-dependent defocusing is asymmetrical, a color-dependent defocusing error $\Delta$ substantially having a first and fifth-order dependence upon the landing spot of the electron beam on the screen. For example, along the line axis, the color-dependent defocusing error is dependent on the distance X between the landing spot and the field axis, in accordance with $$\Delta=c_1X+c_5X^5 \quad (1)$$

in which c1 and c5 are constants. The partial solution described in EP-A-0 899 768 may sufficiently compensate the linear term, however, the fifth-order term is dominant in cathode ray tubes having relatively large deflection angles of the electron beams, i.e. relatively large values of X.

In the cathode ray tube according to the invention, color-dependent defocusing can be compensated asymmetrically so that an improved focusing of the outer electron beams at the edges, and particularly in the corners, of the display screen can be achieved.

Generally, the first and the second electron lens are astigmatic, i.e. the first and the second electron lens focus in a first direction and defocus in a second direction which is perpendicular to the first direction. For example, both electron lenses focus in a horizontal direction and both defocus in a vertical direction.

The cathode ray tube according to the invention provides a further advantage if the deflection means are self-convergent in a first direction, for example, the horizontal direction. In this case, the strength of the main lens should be adaptable in such a way that it compensates the effect of the first electron lens and of the second electron lens in the first direction. Consequently, in the first direction, the electron beams can be held substantially in focus throughout the display screen.

The partial solution which is known from the above-mentioned patent application EP-A-0 899 768 consists of an extra electron-optical quadrupolar lens which is placed between the focusing electrode and the DAF section and acts on the outer electron beams. The effect of this extra lens cannot be compensated by adapting the main lens so that this solution changes the focusing of the outer electron beams in the first direction.

In an embodiment of the cathode ray tube, the strength of the first outer electron beam is larger, in operation, for the first electron lens than the strength of the middle electron beam, and the strength of the second outer electron beam is larger than the strength of the middle electron beam. In a formula, this can be indicated by S1R>S1G>S1B, wherein the strength of the first electron lens for the first outer electron beam is denoted by S1R, for the middle electron beam by S1G and for the second outer electron beam by S1B.

Alternatively, the strength of the first outer electron beam may be smaller than the strength of the middle electron beam for the first electron lens, and the strength of the second outer electron beam may be larger than the strength of the middle electron beam. In a formula, this can be indicated by S1R<S1G<S1B.

In a further advantageous embodiment, the strengths of the first and the second electron lens are equal for the middle electron beam, the strength of the first electron lens for the first outer electron beam is equal to the strength of the second electron lens for the second outer electron beam, and the strength of the first electron lens for the second outer electron beam is equal to the strength of the second electron lens for the first outer electron beam. In a formula, this can be indicated by S1G=S2G, S1R=S2B and S1B=S2R, in which the strength of the second electron lens for the first outer electron beam is indicated by S2R, for the middle electron beam by S2G and for the second outer electron beam by S2B.

This is advantageous because the first outer electron beam generally has a substantially equal behavior on the east side of the display screen as the second outer electron beam has on the west side of the display screen, and vice versa.

Generally, it is simplest to realize the electron lenses with electric means. To this end, a focusing electrode is present between the beam-shaping section and the DAF section in a special embodiment of the cathode ray tube, which focusing electrode is provided on the side of the DAF section with apertures, which mutually differ in shape, for passing the electron beams, and the DAF section comprises a first intermediate electrode and a second intermediate electrode, the second intermediate electrode being placed between the first intermediate electrode and the main lens. On the side of the focusing electrode as well as on the side of the second intermediate electrode, the first intermediate electrode is provided with apertures of mutually different shapes for passing the electron beams. On the side of the first intermediate electrode, the second intermediate electrode also has apertures of mutually different shapes for passing the electron beams. In this way, electron lenses with mutually different strengths for the three electron beams can be easily realized by applying an electric field between facing apertures.

Particularly, the first electron lens can be formed, in operation, by applying an electric field between the apertures in the focusing electrode and the apertures facing it in the first intermediate electrode, the first intermediate electrode receiving a dynamic voltage Vdyn1. In operation, the second electron lens can be formed by applying a second electric field between the apertures in the second intermediate electrode and the apertures facing it in the first intermediate electrode, the second intermediate electrode receiving a second dynamic voltage Vdyn2. The strengths of the second electron lens are proportional to a difference voltage Vdyn2–Vdyn1. The strength of the main lens is also adapted by the second dynamic voltage Vdyn2.

Generally, both the first dynamic voltage Vdyn1 and the second dynamic voltage Vdyn2 are synchronized with a picture signal received by the cathode ray tube. However, their amplitudes are independent of each other so that the strengths of the second electron lens are changeable independently of the strengths of the first electron lens.

Furthermore, the DAF section may comprise a third electron lens which has mutually different strengths for the electron beams, the strengths of the third electron lens being changeable independently of the strengths of the first and the second electron lens. The focusing for each color can be adapted independently with such a DAF section. This provides an advantage if the color-dependent defocusing has a very strong asymmetry. Moreover, this may be advantageous if strict requirements are imposed on the spot size, such as in a FIT tube, in which the spot size in a direction perpendicular to the phosphor tracks, which is generally the vertical direction, should be limited to about 300 micrometers so as to prevent color errors.

An extra electrode configuration which precedes the DAF section and with which the focusing can be adapted independently for each electron beam, is known per se from patent application JP-A-2000011916. However, in this patent application, use is made of unconventional elements which are expensive and difficult to manufacture in comparison with the traditional electron lenses used in the cathode ray tube according to the invention.

An embodiment of the cathode ray tube, in which a third electron lens is present in the DAF section, has a third intermediate electrode which is placed between the second intermediate electrode and the main lens and is provided on the side of the second intermediate electrode with apertures of mutually different shapes for passing the electron beams. In operation, the third electron lens can then be formed by applying a third electric field between the apertures in the third intermediate electrode and the apertures facing it for passing the electron beams in the second intermediate electrode.

For applying the third electric field, the third intermediate electrode receives a third dynamic voltage Vdyn3. The strengths of the third electron lens are proportional to a difference voltage Vdyn3–Vdyn2. Also the third dynamic voltage Vdyn3 is synchronized with the picture signal but has an amplitude which is independent of Vdynl and Vdyn2. Consequently, the strengths of the third electron lens are changeable independently of the strengths of the first and the second electron lens.

In such an embodiment, the first, second and third intermediate electrodes can be placed in the DAF section in any arbitrary sequence. It will be evident that, in operation, any combination constitutes a first, a second and a third electron lens having strengths which are mutually different for the three electron beams and are changeable independently of each other.

These and other aspects of the invention are apparent from and will be elucidated with reference to the embodiments described hereinafter.

DETAILED DESCRIPTION OF THE PREFERRED EMBODIMENTS

Figure 1:
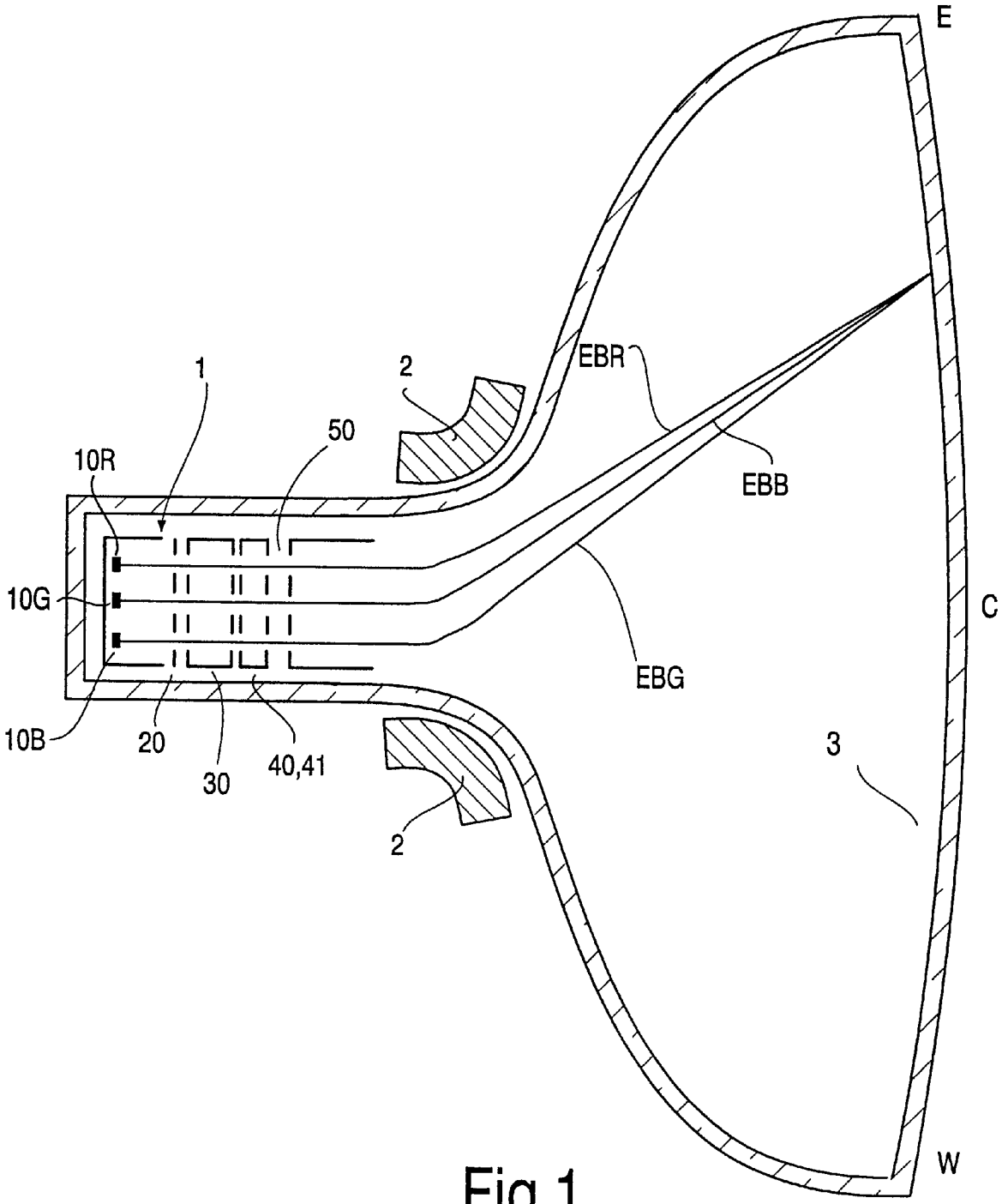
FIG. 1 shows diagrammatically the known color cathode ray tube, with the paths of the three electron beams.

In the known color cathode ray tube as shown in FIG. 1, an electron gun 1 generates a first outer electron beam EBR, which corresponds to the color red, a middle electron beam EBG, which corresponds to the color green, and a second outer electron beam EBB which corresponds to the color blue.

The gun comprises three electron sources 10R, 10G, 10B which emit electrons. In a beam-shaping section 20, the emitted electrons are formed into the respective electron beams EBR, EBG, EBB. These electron beams are imaged by the lens system 30, 40, 50 on the display screen 3 of the cathode ray tube. To accelerate the electrons through the electron gun 1, the display screen 3 receives an anode voltage Va of, for example, 30 kV.

The focusing electrode 30 receives a fixed focusing voltage Vf. Generally, this voltage is approximately 25% of the anode voltage Va, for example, 7.5 kV.

The DAF section 40 comprises a single intermediate electrode receiving a dynamic focusing voltage Vdaf. The value of the dynamic focusing voltage Vdaf is dependent on the deflection of the electron beams EBR, EBG, EBB and is largest if the electron beams EBR, EBG, EBB land in the corners of the display screen 3. The dynamic focusing voltage Vdaf is equal to, for example, Vf if the electron beams land in the center C of the display screen 3, and is 1 kV larger in the corners. For cathode ray tubes having relatively large deflection angles, for example, 120 degrees or more, larger dynamic focusing voltages are required in the corners.

Since vertical and horizontal rectangular apertures are provided in the facing sides of the focusing electrode 30 and the DAF section 40, respectively, an electron-optical quadrupolar lens can be formed between the focusing electrode 30 and the DAF section 40, which lens has a strength which increases with an increasing dynamic focusing voltage. This electron-optical quadrupolar lens is used for the purpose of optimally compensating the astigmatism produced in the electron beams EBR, EBG, EBB due to the deflection by the deflection means 2.

The main lens 50 focuses the electron beams EBR, EBG, EBB on the display screen 3. The main lens 50 has a strength which is proportional to the difference between the anode voltage Va and the dynamic focusing voltage Vdaf. With an increasing Vdaf, the strength of the main lens 50 decreases. This measure compensates the change of focusing of the electron beams EBR, EBG, EBB, caused by the fact that the electron beams cover a longer path between the main lens 50 and the display screen 3 as a result of the deflection by the deflection means 2.

At the area of the deflection means 2, the electron beams EBR, EBG, EBB are situated with respect to each other at a given distance p in the "in-line" plane. This distance p is referred to as "gun pitch" and is, for example, 6 mm. Upon deflection of the electron beams EBR, EBG, EBB, the deflection means 2 constitute an electron lens with a different strength for each color, which is the deflection lens already described.

Generally, the deflection means 2 for each color are self-convergent in the horizontal direction so that the electron beams EBR, EBG, EBB are substantially in focus throughout the display screen 3 in the horizontal direction. The lens action of the DAF section 40 can therefore be compensated in the horizontal direction by adapting the strength of the main lens 50 so that the focusing of the electron beams EBR, EBG, EBB in the horizontal direction does not change.

Figure 2:
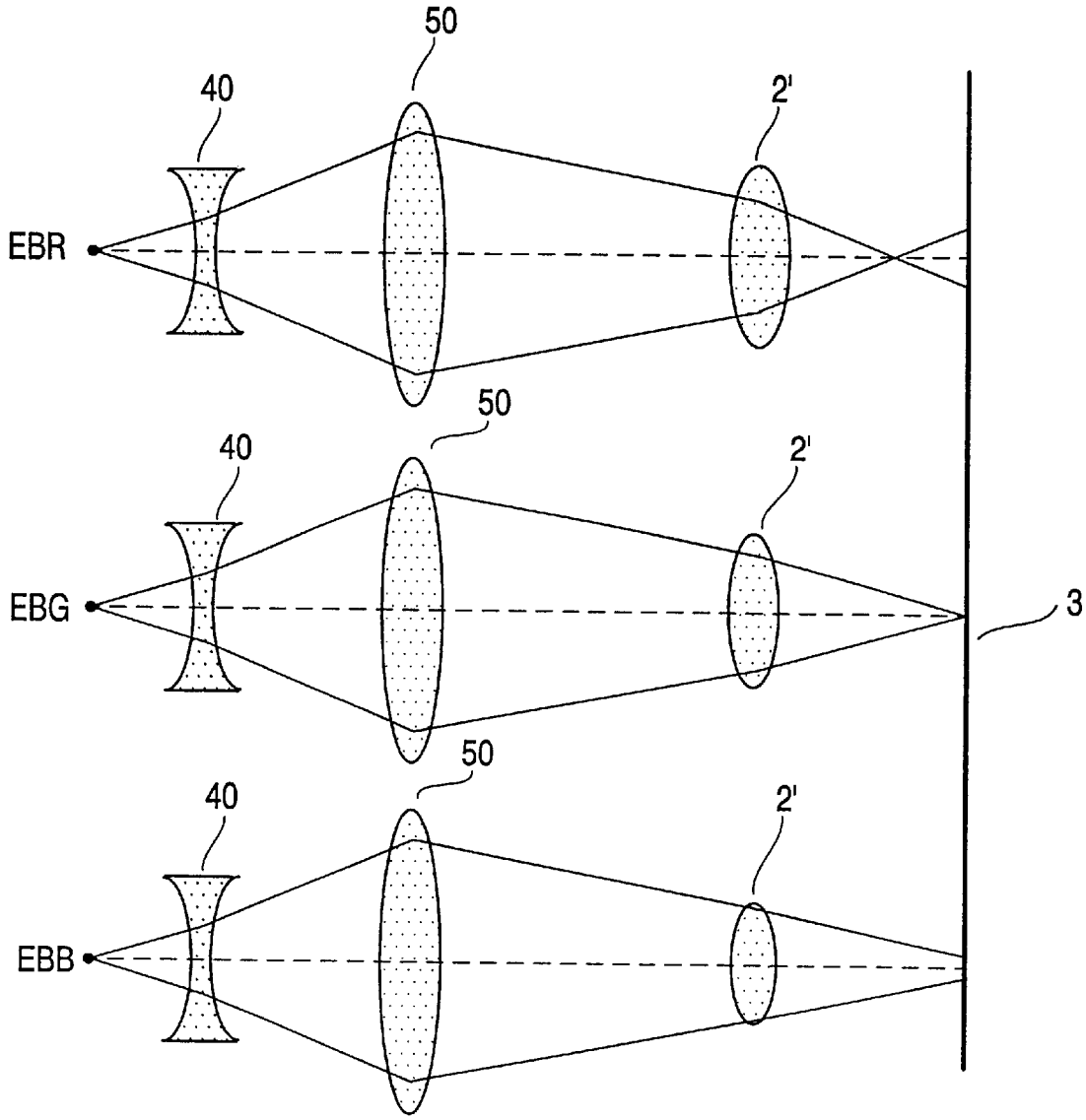
FIG. 2 shows an equivalent optical lens model of the known cathode ray tube.

FIG. 2 shows an equivalent optical lens model of the known color cathode ray tube in operation, in which the landing spot of the electron beams EBR, EBG, EBB is located near the east edge of the display screen 3.

The Figure is a cross-section of the lens system comprising the DAF section 40, the main lens 50 and the deflection lens 2', in a plane perpendicular to the "n-line" plane.

In the electron gun 1, the DAF section 40 and the main lens 50 have substantially the same strength for each color, while the strength of the deflection lens 2' is different for each color. Consequently, during deflection, it is not possible for each one of the electron beams EBR, EBG, EBB to be in focus in the vertical direction on the display screen 3.

Figure 3:
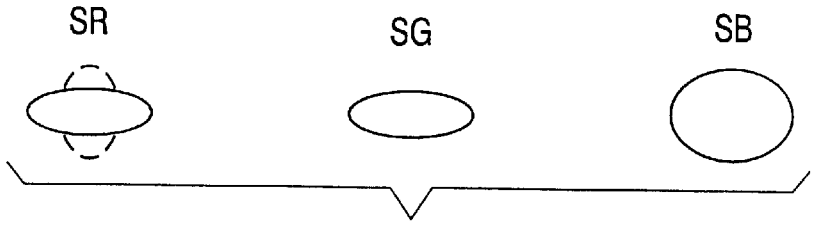
FIG. 3 shows the spots of the electron beams in the known cathode ray tube.

The electron gun 1 is optimized for the green electron beam EBG, so that the spot BSG of the green electron beam has an optimal focusing. This is elucidated by means of the spots BSR, BSG, BSB in FIG. 3.

The spot BSR of the red electron beam EBR is overfocused in the vertical direction because the deflection lens 2' for the red electron beam is relatively strong in the vertical direction, while the spot BSB of the blue electron beam EBB is underfocused in the vertical direction because the deflection lens 2' for the blue electron beam EBB is relatively weak in the vertical direction.

Figure 4:
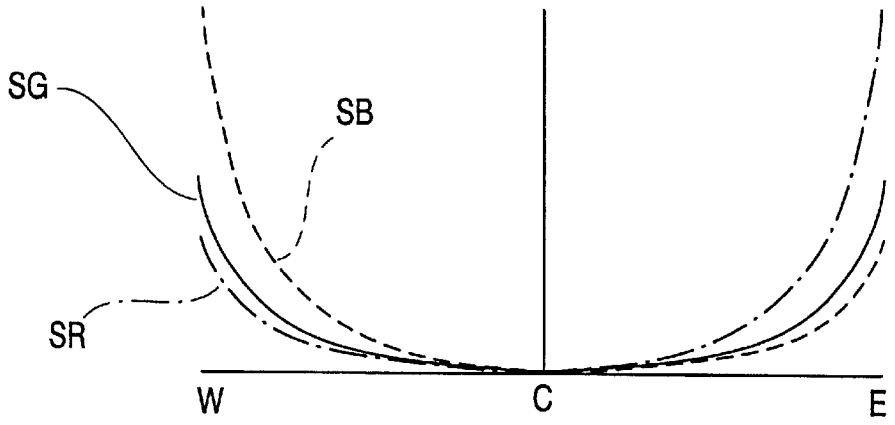
FIG. 4 shows diagrammatically the asymmetry in the color-dependent defocusing.

The effect of color-dependent defocusing is asymmetrical, as is shown in FIG. 4 for a conventional color cathode ray tube. In this Figure, the required lens strengths SR, SG, SB for the three electron beams EBR, EBG, EBB are shown in dependence upon the landing spot along the field axis of the electron beams EBR, EBG, EBB.

It can be seen that, on the west side of the display screen, which is the right-hand side to a person viewing the display screen from the exterior, the difference SG-SB between the required lens strength SG for the middle electron beam EBG and the required lens strength SB for the second outer electron beam EBB is larger than the difference SR-SG between the required lens strength SR for the first outer electron beam EBR and the required lens strength SG for the middle electron beam EBG. The required lens strength is herein understood to mean the lens strength in the vertical direction, at which the electron beam is in focus on the display screen.

It can also be seen that, on the east side of the display screen, which is the left-hand side to a person viewing the screen from the exterior, the difference SB-SG between the required lens strength SB for the second outer electron beam EBB and the required lens strength SG for the middle electron beam EBG is smaller than the difference SG-SR between the required lens strength SG for the middle electron beam EBG and the required lens strength SR for the first outer electron beam EBR.

For example, in a 36" Wide Screen Real Flat cathode ray tube, as supplied by L G Philips Displays, with a deflection angle of 103 degrees, the required lens strength for red SR=−40 dioptry in the north-east corner of the screen, the required lens strength for green SG=−26 dioptry and the required lens strength for blue SB=−21 dioptry. Thus, there is asymmetry between the difference of the required lens strengths for red and green, SR-SG=−14 dioptry, and the difference of the required lens strengths for blue and green, SG-SB=−5 dioptry.

Generally, the first outer electron beam on the west side of the display screen has substantially the same behavior as the second outer electron beam on the east side of the display screen, and vice versa.

In the example described, the required lens strength for red SR=−21 dioptry in the north-west corner of the screen, the required lens strength for green SG=−26 dioptry and the required lens strength for blue SB=−40 dioptry.

Figure 5:
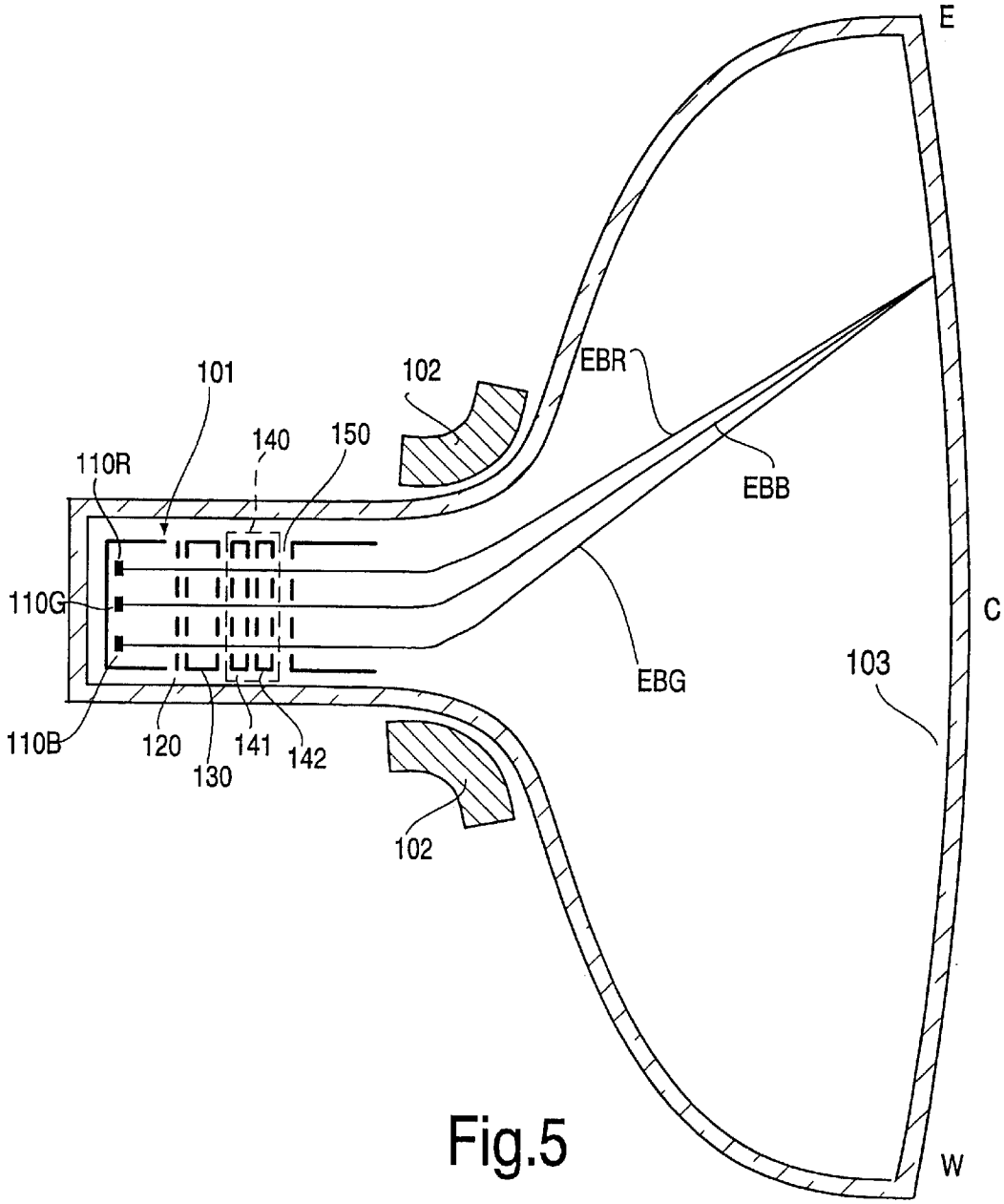
FIG. 5 is a cross-section of a first embodiment of a cathode ray tube according to the invention.
Figure 6:
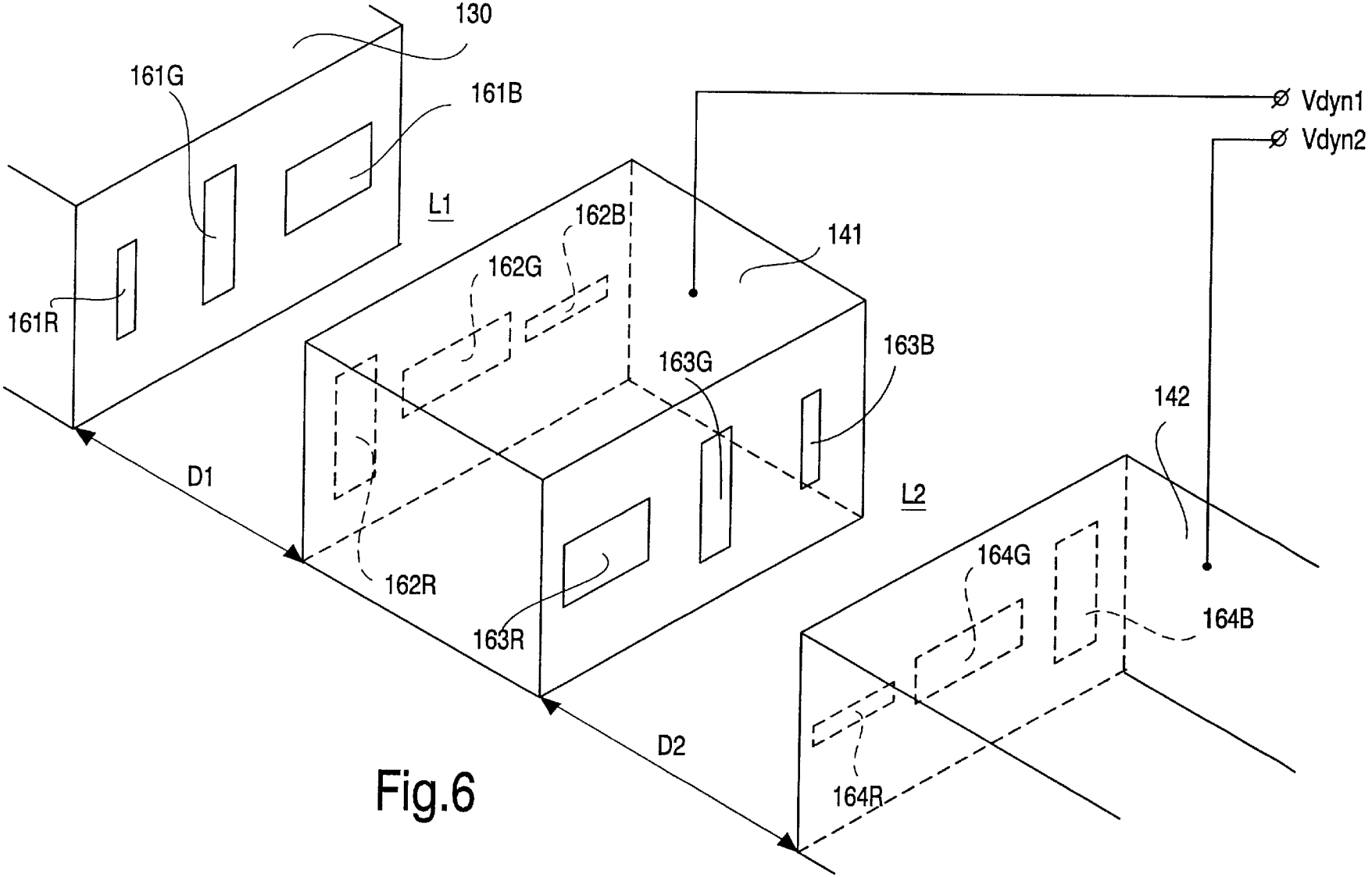
FIG. 6 is an isometric representation of the DAF section of the cathode ray tube in accordance with the first embodiment.

A first embodiment of a cathode ray tube according to the invention has an electron gun 101 with a DAF section 140 which consists of a first intermediate electrode 141 and a second intermediate electrode 142, as is shown in FIG. 5. The DAF section 140 is shown in greater detail in FIG. 6.

In the electron gun 101, the sources 110R, 110G, 110B emit electrons. These emitted electrons can be formed into the electron beams EBR, EBG, EBB by a beam-shaping section 120.

The first intermediate electrode 141 is situated at a distance D1 of, for example, 0.4 mm from the focusing electrode 130 and is coupled to a first dynamic voltage source Vdyn1, by which, in operation, a first electron lens L1 can be formed between apertures 161R,G,B in the focusing electrode 30 and apertures 162R,G,B in the side of the first intermediate electrode 141 facing the focusing electrode. The strengths in the vertical direction S1R, S1G, S1B of the first electron lens L1 are then dependent on the first dynamic focusing voltage Vdyn1.

The second intermediate electrode 142 is situated at a distance D2 of, for example, 0.4 mm from the first intermediate electrode 141 and is coupled to a second dynamic voltage source Vdyn2, by which, in operation, a second electron lens L2 can be formed between apertures 164R,G,B in the second intermediate electrode 142 and apertures 163R,G,B in the side of the first intermediate electrode 141 facing the second intermediate electrode. The strengths in the vertical direction S2R, S2G, S2B of the second electron lens L2 are then dependent on the difference Vdyn2−Vdyn1 between the second dynamic focusing voltage Vdyn2 and the first dynamic focusing voltage Vdyn1.

With an increasing Vdyn2, the strength of the main lens for all of the three electron beams EBR, EBG, EBB decreases to an equal extent.

The deflection means 102 in the cathode ray tube are self-convergent in the horizontal direction. The first electron lens L1 and the second electron lens L2 are made in such a way that the effect of the linear combination of the first electron lens L1 and the second electron lens L2 in the horizontal direction can be compensated by adapting the strength of the main lens 50. Consequently, in operation, the electron beams EBR, EBG, EBB remain substantially in focus in the horizontal direction throughout the display screen.

The apertures 161R,G,B . . . 164R,G,B are rectangular and have dimensions in the horizontal direction (x) and the vertical direction (y) as indicated in Table 1. The apertures have a mutually different shape so that the first electron lens L1 and the second electron lens L2 for the electron beams EBR, EBG, EBB have mutually different strengths in the vertical direction S1R, S1G, S1B; S2R, S2G, S2B.

TABLE 1

Dimensions of the apertures 161R, G, B . . . 164R, G, B

| | | | R | G | B |
|---|---|---|---|---|---|
| L1 | 161 | x | 0.70 mm | 1.15 mm | 3.39 mm |
| | | y | 3.10 mm | 4.25 mm | 2.21 mm |
| | 162 | x | 1.60 mm | 4.25 mm | 3.24 mm |
| | | y | 4.24 mm | 1.15 mm | 0.70 mm |
| L2 | 163 | x | 3.39 mm | 1.15 mm | 0.70 mm |
| | | y | 2.21 mm | 4.25 mm | 3.10 mm |
| | 164 | x | 3.24 mm | 4.25 mm | 1.60 mm |
| | | y | 0.70 mm | 1.15 mm | 4.24 mm |

It has been found that a linear combination L1+L2 of the electron lenses L1, L2, formed in operation between such apertures 161R,G,B . . . 164R,G,B satisfactorily compensate color-dependent defocusing in the vertical direction.

Figure 7:
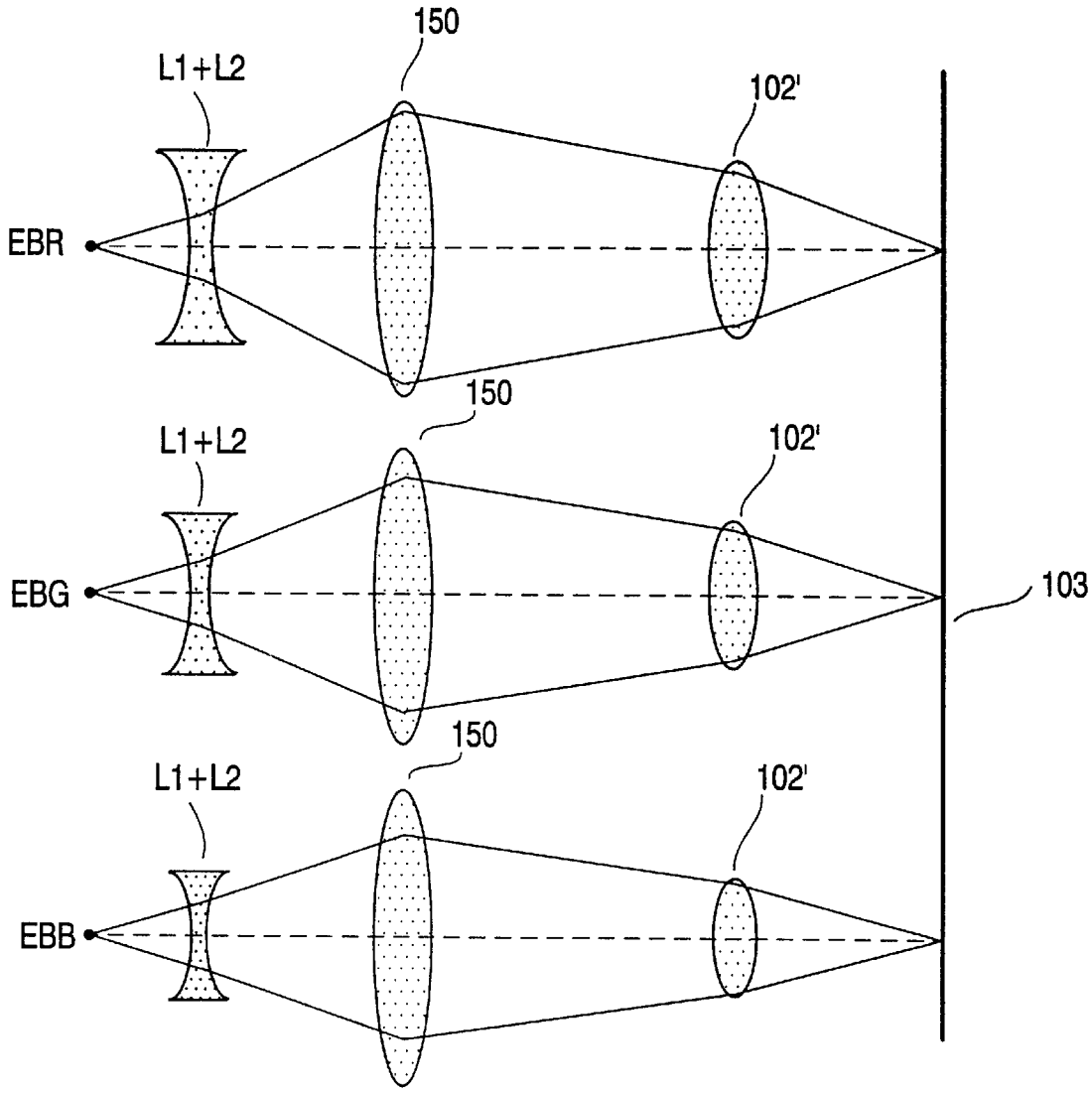
FIG. 7 shows an equivalent optical lens model of the first embodiment.

An equivalent optical lens model of the first embodiment is shown in FIG. 7. The Figure shows the lens action of the linear combination L1+L2 of the first electron lens L1 and the second electron lens L2, the main lens 150 and the deflection lens 102' in a plane perpendicular to the "in-line" plane for the case where the electron beams EBR, EBG, EBB land on the display screen 103 near the east edge E of the display screen 103. If the electron beams EBR, EBG, EBB land near the edges of the display screen, they are deflected by the self-convergent deflection means 102. Consequently, a positive deflection lens 102' is produced in the vertical direction, which lens focuses the electron beams EBR, EBG, EBB.

The deflection lens 102' has mutually different strengths for the three electron beams. As a result, one of the outer electron beams is overfocused near the edge of the display screen. This is compensated because, in operation, the linear combination of the first electron lens L1 and the second electron lens L2 acts on the electron beams EBR, EBG, EBB.

The first electron lens L1 has its own strength for each electron beam EBR, EBG, EBB, the strength for the red electron beam EBR being largest and the strength for the blue electron beam EBB being smallest. The second electron lens L2 also has its own strength for each electron beam EBR, EBG, EBB, the strength for the blue electron beam EBB being largest and the strength for the red electron beam EBR being smallest.

On the east side of the display screen, the first electron lens L1 is stronger than the second electron lens L2, which can be seen in FIG. 7. Consequently, the lens action of the linear combination L1+L2 is strongest for red and weakest for blue.

Figure 8:
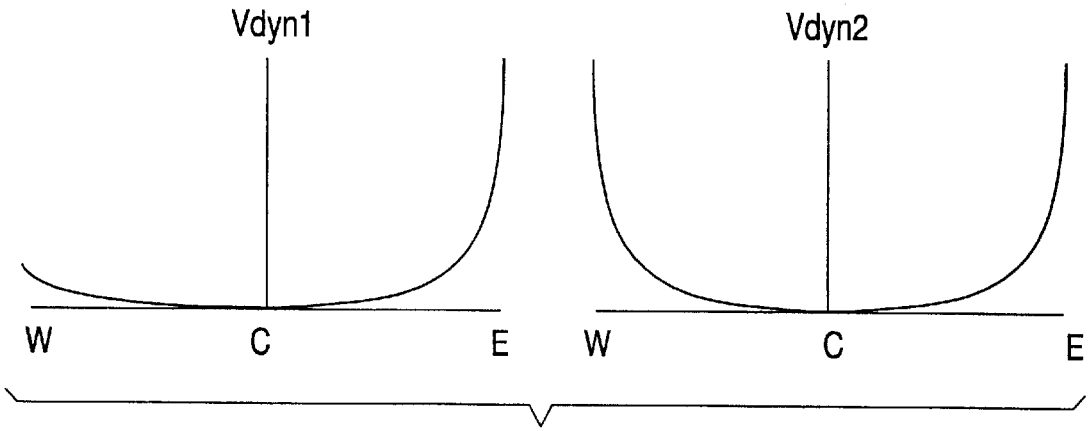
FIG. 8 shows an example of a signal shape of the dynamic focusing voltages Vdyn1 and Vdyn2.

Dynamic focusing voltages Vdyn1, Vdyn2 as shown in FIG. 8 may be used for driving the first intermediate electrode 141 and the second intermediate electrode 142. In the Figure, the amplitude of the dynamic focusing voltage Vdyn1, Vdyn2 is shown in dependence upon the landing spot of the electron beams EBR, EBG, EBB along the line axis of the display screen 103.

In the center C of the display screen 103, the dynamic focusing voltages Vdyn1, Vdyn2 are equal to the fixed focusing voltage Vf which is applied to the focusing electrode 130. With an increasing extent of deflection of the electron beams EBR, EBG, EBB, the dynamic focusing voltages Vdyn1, Vdyn2 also increase.

The second dynamic focusing voltage Vdyn2, preferably a fourth-order signal, has, for example, a bathtub shape with a maximum amplitude of 1000 V. On the east side of the center C, the first dynamic focusing voltage Vdyn1 is substantially equal to Vdyn2. For example, near the east edge E of the display screen 103, Vdyn1 has a maximum amplitude of 980 V. However, on the west side of the center C, Vdyn1 is considerably smaller than Vdyn2. For example, near the west edge W of the display screen 103, Vdyn1 has a maximum amplitude of 100 V.

By using such dynamic focusing voltages Vdyn1 and Vdyn2, the first electron lens L1 predominantly acts on the east side of the display screen 103 and the second electron lens L2 predominantly acts on the west side of the display screen 103. In this way, lens action as shown in FIG. 7 can be achieved in operation.

Figure 9:
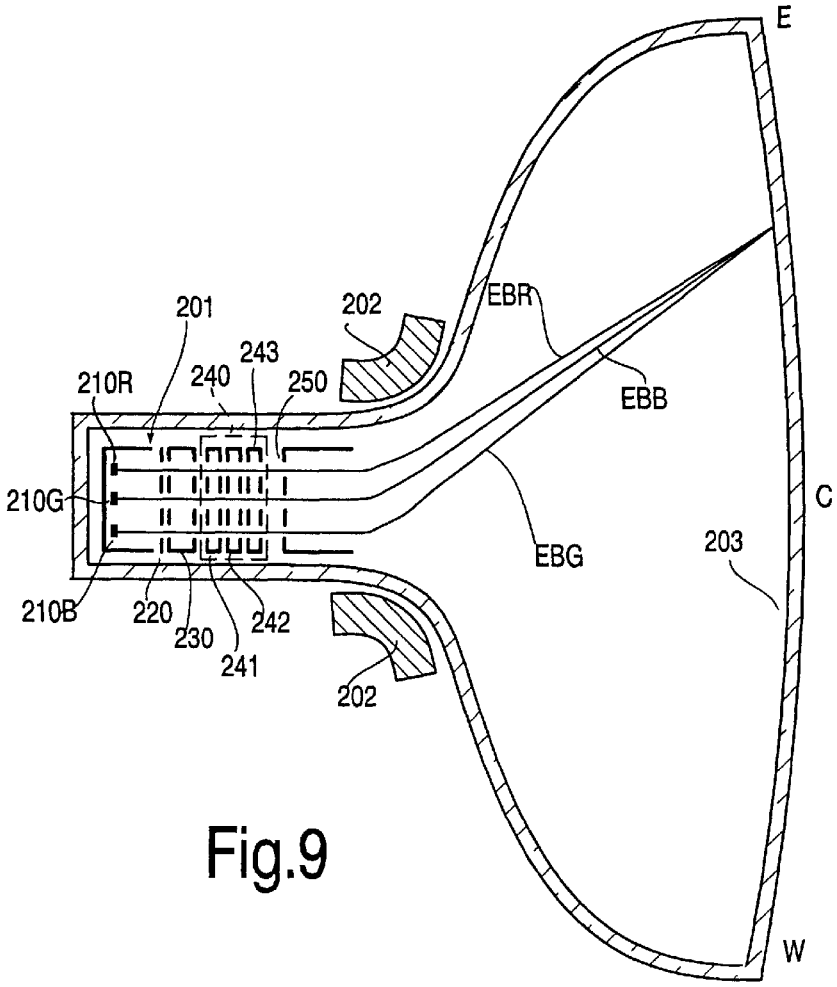
FIG. 9 is a cross-section of a further embodiment of the cathode ray tube.
Figure 10:
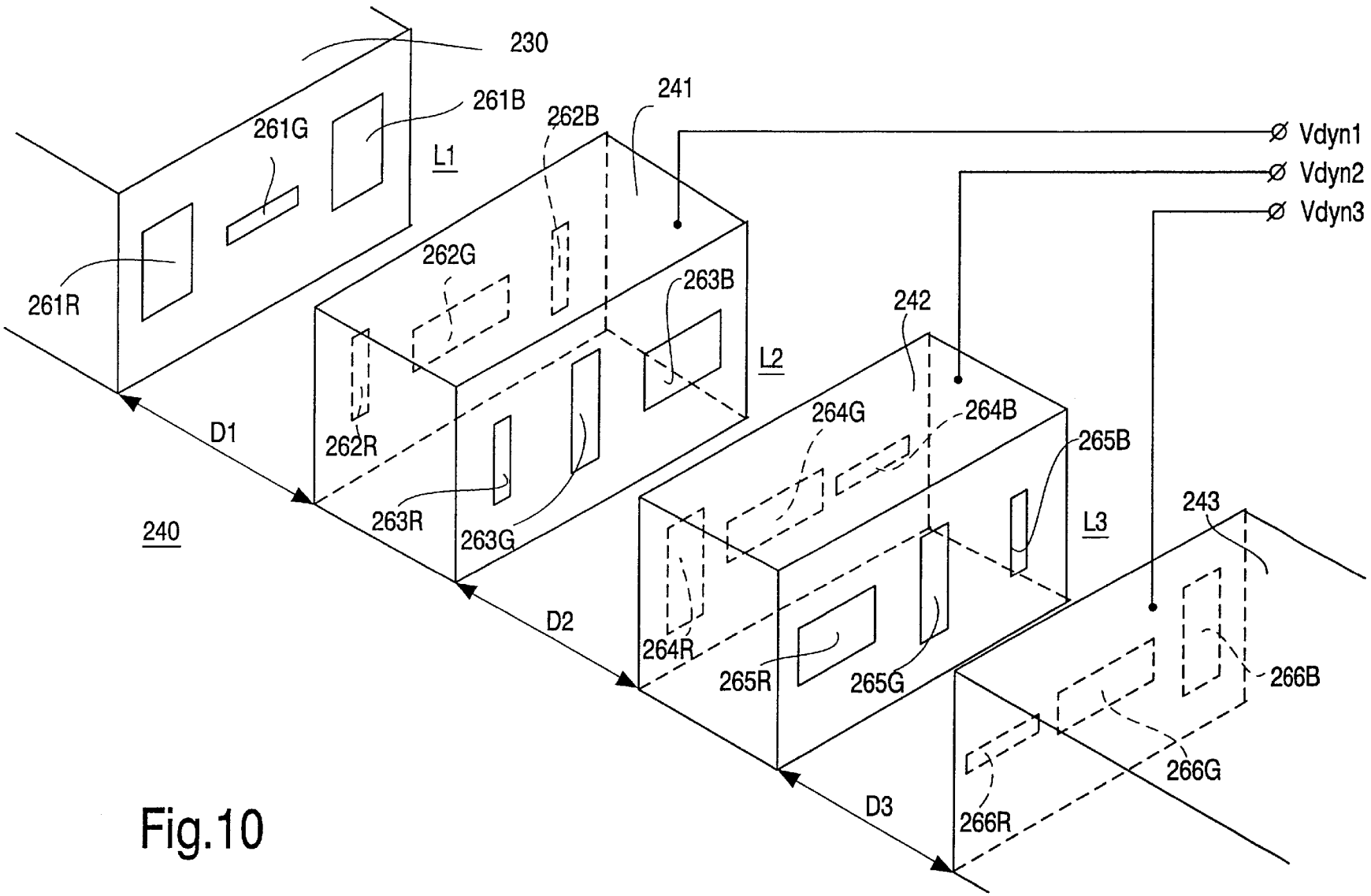
FIG. 10 is an isometric representation of the DAF section of the further embodiment.

A further embodiment of the cathode ray tube comprises an electron gun 201 provided with a DAF section 240 which consists of a first intermediate electrode 241, a second intermediate electrode 242 and a third intermediate electrode 243, as can be seen in FIG. 9. The DAF section 240 is shown in greater detail in FIG. 10.

In the electron gun 201, the sources 210R, 210G, 210B emit electrons. These emitted electrons can be formed into the electron beams EBR, EBG, EBB by a beam-shaping section 220.

The first intermediate electrode 241 is situated at a distance D1 of, for example, 0.4 mm from the focusing electrode 230 and, in operation, receives a first dynamic voltage Vdyn1. The first electron lens L1 can thereby be formed between the apertures 261R,G,B and the apertures 262R,G,B. The strengths S1R, S1G, S1B of the first electron lens L1 are proportional to Vdyn1.

The second intermediate electrode 242 is situated at a distance D2 of, for example, 0.4 mm from the first intermediate electrode 241 and, in operation, receives a second dynamic voltage Vdyn2. The second electron lens L2 can thereby be formed between the apertures 263R,G,B and the apertures 264R,G,B. The strengths S2R, S2G, S2B of the second electron lens L2 are proportional to the difference voltage Vdyn2−Vdyn1.

The third intermediate electrode 243 is situated at a distance D3 of, for example 0.4 mm from the second intermediate electrode 242 and, in operation, receives a third dynamic voltage Vdyn3. The third electron lens L3 can thereby be formed between the apertures 265R,G,B and the apertures 266R,G,B. The strengths S3R, S3G, S3B of the third electron lens L3 are proportional to the difference voltage Vdyn3−Vdyn2.

The deflection means 202 in the cathode ray tube are self-convergent in the horizontal direction. The first electron lens L1, the second electron lens L2 and the third electron lens L3 can be formed in such a way that the effect of the linear combination of the three electron lenses in the horizontal direction can be compensated by adapting the strength of the main lens 50. Consequently, in operation, the electron beams EBR, EBG, EBB remain substantially in focus in the horizontal direction throughout the display screen.

In the further embodiment, the apertures 261R,G,B . . . 266R,G,B are rectangular and have mutually different shapes. Particularly, they have dimensions in the horizontal direction x and in the vertical direction y as shown in Table 2. Consequently, the strengths in the vertical direction S1R, S1G, S1B; S2R, S2G, S2B; S3R, S3G, S3B of the electron lenses L1, L2, L3 for the three electron beams EBR, EBG, EBB are mutually different.

TABLE 2

Dimensions of the apertures 261R, G, B . . . 266R, G, B

| | | | R | G | B |
|---|---|---|---|---|---|
| L1 | 261 | x | 2.21 mm | 3.10 mm | 2.21 mm |
| | | y | 3.39 mm | 0.70 mm | 3.39 mm |
| | 262 | x | 0.70 mm | 4.24 mm | 0.70 mm |
| | | y | 3.24 mm | 1.60 mm | 3.24 mm |
| L2 | 263 | x | 0.70 mm | 1.15 mm | 3.39 mm |
| | | y | 3.10 mm | 4.25 mm | 2.21 mm |
| | 264 | x | 1.60 mm | 4.25 mm | 3.24 mm |
| | | y | 4.24 mm | 1.15 mm | 0.70 mm |
| L3 | 265 | x | 3.39 mm | 1.15 mm | 0.70 mm |
| | | y | 2.21 mm | 4.25 mm | 3.10 mm |
| | 266 | x | 3.24 mm | 4.25 mm | 1.60 mm |
| | | y | 0.70 mm | 1.15 mm | 4.24 mm |

In the given configuration, the focusing for each color can be adjusted as optimally as possible by means of the linear combination L1+L2+L3 of the electron lenses L1, L2, L3, formed in operation between the apertures 261R,G,B . . . 266R,G,B. This embodiment is preferably applicable as a FIT cathode ray tube which does not have a shadow mask.

Figure 11:
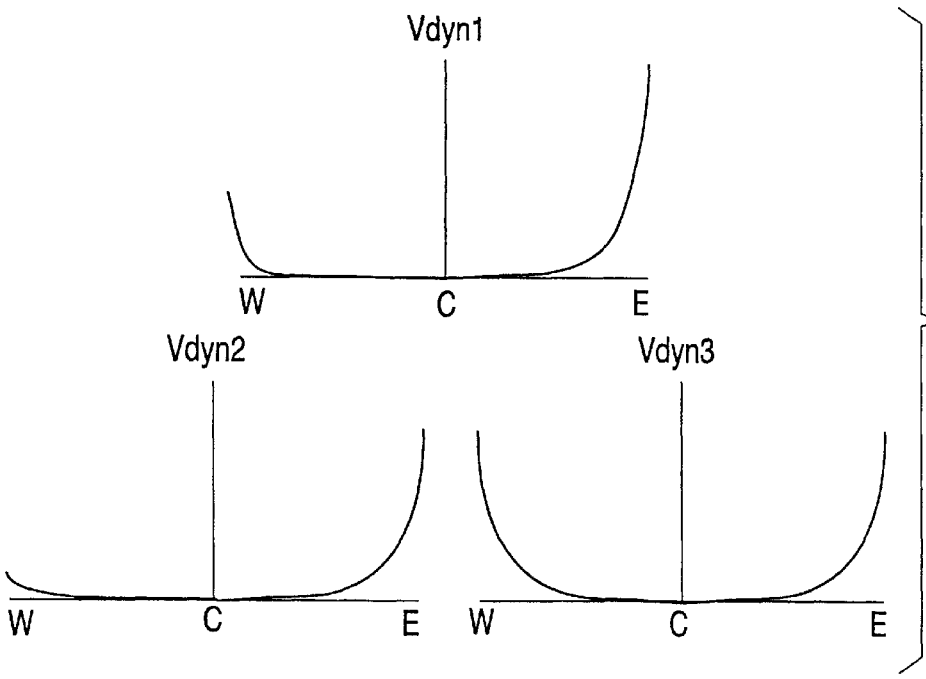
FIG. 11 shows an example of a signal shape of the dynamic focusing voltages Vdyn1, Vdyn2 and Vdyn3.

Dynamic focusing voltages Vdyn1, Vdyn2, Vdyn3 as shown in FIG. 11 can be used for driving the first intermediate electrode 241, the second intermediate electrode 242 and the third intermediate electrode 243.

In the Figure, the amplitude of the dynamic focusing voltages Vdyn1, Vdyn2, Vdyn3 is shown in dependence upon the landing spot of the electron beams EBR, EBG, EBB along the line axis of the display screen 203. In the center C of the display screen 203, the dynamic focusing voltages Vdyn1, Vdyn2, Vdyn3 are equal to the fixed focusing voltage Vf which is applied to the focusing electrode 230. The dynamic focusing voltages Vdyn1, Vdyn2, Vdyn3 increase with an increasing deflection of the electron beams EBR, EBG, EBB.

The third dynamic focusing voltage Vdyn3 has, for example, a bathtub shape with a maximum amplitude of 1000 V. On the east side of the center C, the second dynamic focusing voltage Vdyn2 is substantially equal to Vdyn3, for example, near the east edge E of the display screen 203, Vdyn2 has a maximum amplitude of 980 V. However, on the west side of the center C, Vdyn2 is considerably smaller than Vdyn3, for example, near the west edge W of the display screen 203, Vdyn2 has a maximum amplitude of 100 V.

The first dynamic focusing voltage Vdyn1 is equal to the second dynamic focusing voltage Vdyn2 in the greater part of the display screen. For relatively large deflection angles of the electron beams EBR, EBG, EBB, Vdyn1 is, however, larger than Vdyn2. For example, on the west edge W and the east edge E of the display screen, Vdyn1 is 300 V larger than Vdyn2.

In the further embodiment, the second electron lens L2 focuses the electron beams EBR, EBG, EBB mainly on the east side of the display screen 203, the third electron lens L3 focuses the electron beams EBR, EBG, EBB mainly on the west side of the display screen 203 and the first electron lens L1 constitutes a correction lens.

Figure 12:
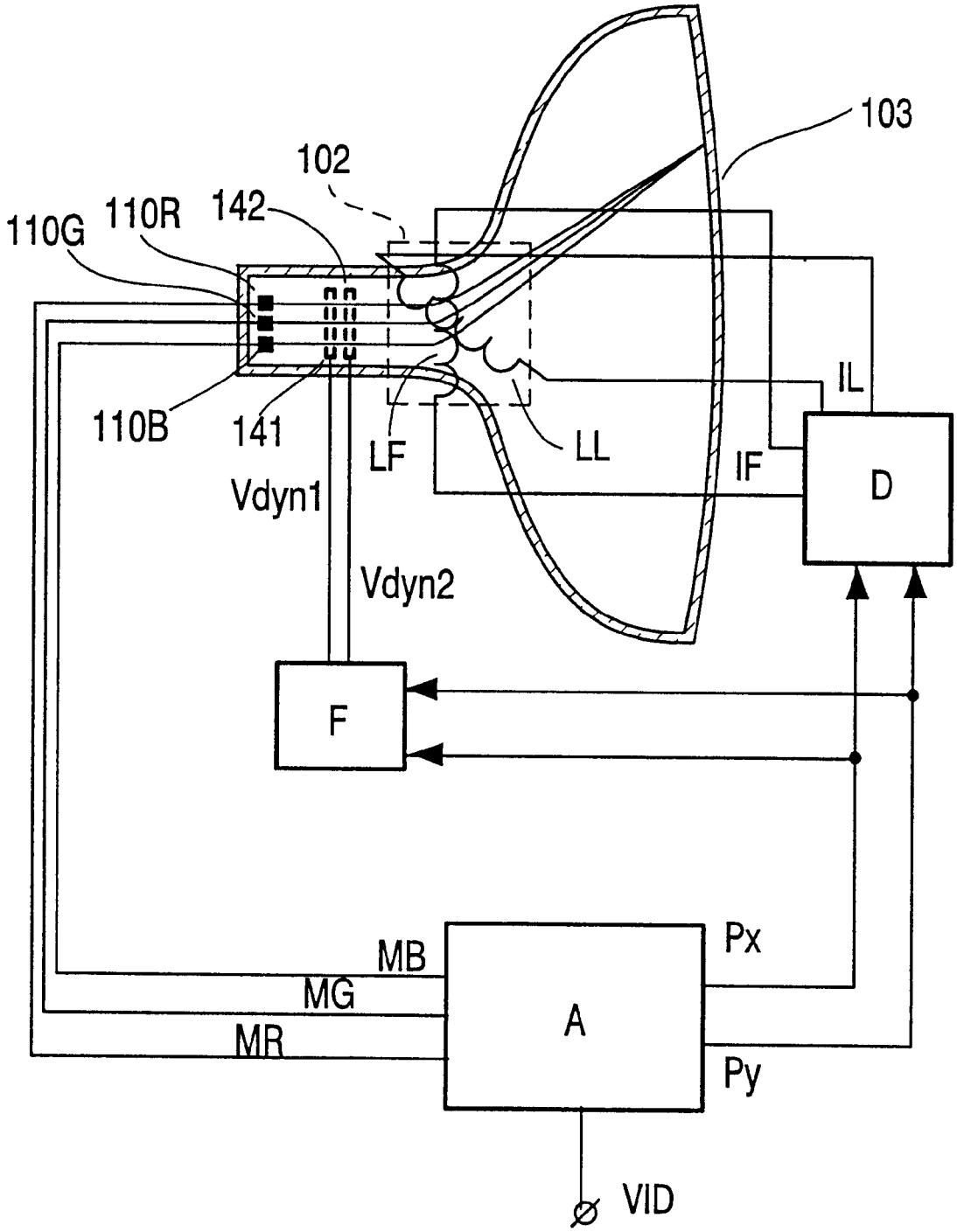
FIG. 12 shows a picture display device comprising a cathode ray tube according to the invention.

A picture display device comprising the first embodiment of the cathode ray tube according to the invention is shown in FIG. 12.

A control unit A in the picture display device is adapted to receive a picture signal VID for generating, in operation, modulation signals MR, MG, MB and position signals Px and Py.

The modulation signals MR, MG, MB can be applied to the respective electron sources 110R, 110G, 110B for modulating the current density of the electron beams EBR, EBG, EBB and thereby changing an intensity with which the red, green and blue phosphors luminesce on the display screen 103 at the location of a landing spot of the electron beams EBR, EBG, EBB, respectively.

The position signals Px and Py can be applied to a deflection circuit D which forms a line-frequency deflection current IL and a field-frequency deflection current IF. The deflection means 102 can be coupled to the deflection circuit D for receiving the deflection currents IL, IF. Particularly, the deflection means 102 comprise a line deflection coil LL which receives the line-frequency deflection current IL for deflecting, in operation, the electron beams EBR, EBG, EBB in the horizontal direction. Furthermore, the deflection means 102 comprise a field deflection coil LF which receives the field-frequency deflection current If for deflecting, in operation, the electron beams EBR, EBG, EBB in the vertical direction.

The position signals Px and Py can also be applied to a focusing circuit F for generating, in synchronism therewith, dynamic focusing voltages Vdyn1 and Vdyn2. In operation, the first intermediate electrode 141 receives the first dynamic focusing voltage Vdyn1 and the second intermediate electrode 142 receives the second dynamic focusing voltage Vdyn2.

The Figures are diagrammatic and not drawn to scale. It will be evident that the invention is illustrated by the Figures and their description, but is not limited thereto. The embodiments described above, particularly the configurations of intermediate electrodes with apertures and amplitudes and signal shapes of dynamic focusing voltages are only among the possibilities of realizing a first electron lens, a second electron lens and, if applicable, a third electron lens. Those skilled in the art will be able to construct many alternative embodiments of a cathode ray tube and a picture display device according to the invention.

What is claimed is:

1. A cathode ray tube (CRT) including an electron-optical system and a display screen for converting an electron-optical image into a light image, the electron-optical system comprising:

electron sources, juxtaposed in a plane, for emitting electrons;

a beam-shaping section for Corning a first outer electron beam, a middle electron beam and a second outer electron beam from the electrons emitted by the respective electron sources;

a main lens for focusing the electron beams on the display screen;

deflection means for deflecting the electron beams across the display screen, and a DAF section for dynamically adapting the focusing and astigmatism of the electron beams in dependence upon a landing spot of the electron beams on the display screen, wherein the DAF section comprises a first electron lens, which has mutually different strengths for the electron beams, and a second electron lens, which has mutually different strengths for the electron beams, the strengths of the second electron lens being changeable independently of the strengths of the first electron lens.

2. The cathode ray tube of claim 1, wherein, in the first electron lens, the strength for the first outer electron beam is larger than the strength for the middle electron beam, and the strength for the second outer electron beam is smaller than the strength for the middle electron beam.

3. The cathode ray tube of claim 2, wherein the strengths of the first electron lens and the second electron lens for the middle electron beam are substantially equal, and the strength of the first electron lens for the first outer electron beam is substantially equal to the strength of the second electron lens for the second outer electron beam, and the strength of the first electron lens for the second outer electron beam is substantially equal to the strength of the second electron lens for the first outer electron beam.

4. A picture display device comprising the cathode ray tube of claim 2.

5. The cathode ray tube of claim 1, wherein, in the first electron lens, the strength for the first outer electron beam is smaller than the strength for the middle electron beam, and the strength for the second outer electron beam is larger than the strength for the middle electron beam.

6. The cathode ray tube of claim 5, wherein the strengths of the first electron lens and the second electron lens for the middle electron beam are substantially equal, and the strength of the first electron lens for the first outer electron beam is substantially equal to the strength of the second electron lens for the second outer electron beam, and the strength of the first electron lens for the second outer electron beam is substantially equal to the strength of the second electron lens for the first outer electron beam.

7. The cathode ray tube of claim 1, wherein the strengths of the first electron lens and the second electron lens for the middle electron beam are substantially equal, and the strength of the first electron lens for the first outer electron beam is substantially equal to the strength of the second electron lens for the second outer electron beam, and the strength of the first electron lens for the second outer electron beam is substantially equal to the strength of the second electron lens for the first outer electron beam.

8. The cathode ray tube of claim 1, wherein a focusing electrode is arranged between the beam-shaping section and the DAF section, which focusing electrode is provided on the side facing the DAF section with apertures of mutually different shapes for passing the electron beams, and the DAF section comprises a first intermediate electrode and a second intermediate electrode, the second intermediate electrode being placed between the first intermediate electrode and the main lens, and the first intermediate electrode is provided on the side facing the focusing electrode with apertures of mutually different shapes for passing the electron beams, and on the side facing the second intermediate electrode with apertures of mutually different shapes for passing the electron beams, and the second intermediate electrode is provided on the side facing the first intermediate electrode with apertures of mutually different shapes for passing the electron beams.

9. The cathode ray tube of claim 8, configured for forming the first electron lens by applying a first electric field between the apertures in the focusing electrode and the apertures in the first intermediate electrode, and for applying the first electric field, in operation, by coupling the first intermediate electrode to a first dynamic voltage source, and configured for forming the second electron lens by applying a second electric field between the apertures in the first intermediate electrode and the apertures in the second intermediate electrode, and for applying the second electric field, in operation, by coupling the second intermediate electrode to a second dynamic voltage source.

10. The cathode ray tube of claim 9, wherein the DAF section includes a third intermediate electrode which placed between the second intermediate electrode and the main lens, and configured for forming the third electron lens by applying a third electric field between apertures of mutually different shapes for passing the electron beams in the third intermediate electrode and apertures of mutually different shapes for passing the electron beams in the second intermediate electrode, and for applying the third electric field, in operation, by coupling the third intermediate electrode to a third dynamic voltage source.

11. The cathode ray tube of claim 1, wherein the DAF section comprises a third electron lens which has mutually different strengths for the electron beams the strengths of the third electron lens being changeable independently of the strengths of the first electron lens and the second electron lens.

12. The cathode ray tube of claim 11, wherein the DAF section includes a third intermediate electrode placed between the second intermediate electrode and the main lens, and configured for forming the third electron lens by applying a third electric field between apertures of mutually different shapes for passing the electron beams in the third intermediate electrode and apertures of mutually different shapes for passing the electron beams in the second intermediate electrode, and for applying the third electric field, in operation, by coupling the third intermediate electrode to a third dynamic voltage source.

13. The cathode ray tube of claim 1, wherein the first electron lens and the second electron lens are astigmatic.

14. The cathode ray tube of claim 13, wherein the deflection means are self-convergent in a first direction.

15. A picture display device comprising the cathode ray tube of claim 1.

* * * * *